US006571678B1

(12) United States Patent
Bar

(10) Patent No.: US 6,571,678 B1
(45) Date of Patent: Jun. 3, 2003

(54) AIMING DRIVE

(75) Inventor: Klaus Bar, Lauf (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 65 days.

(21) Appl. No.: 09/696,846

(22) Filed: Oct. 26, 2000

(30) Foreign Application Priority Data

Oct. 28, 1999 (DE) ..... 199 51 915

(51) Int. Cl.[7] ..... F41A 27/00
(52) U.S. Cl. ..... 89/41.02
(58) Field of Search ..... 89/41.02

(56) References Cited

U.S. PATENT DOCUMENTS

| | | | | |
|---|---|---|---|---|
| 2,370,585 A | * | 2/1945 | Scott et al. | 74/388 |
| 3,401,599 A | * | 9/1968 | Schonherr et al. | 89/41 |
| 4,144,797 A | * | 3/1979 | Berge et al. | 89/36.13 |
| 4,305,325 A | * | 12/1981 | Lange et al. | 89/1.815 |
| 4,574,685 A | * | 3/1986 | Sanborn et al. | 89/36.13 |
| 4,686,888 A | * | 8/1987 | Sanborn et al. | 89/37.13 |
| 4,714,004 A | * | 12/1987 | Weinfurth | 89/37.09 |
| 5,661,254 A | | 8/1997 | Steuer et al. | |

FOREIGN PATENT DOCUMENTS

EP 0 149 639 B1 10/1988

* cited by examiner

*Primary Examiner*—Michael J. Carone
*Assistant Examiner*—M. Thomson
(74) *Attorney, Agent, or Firm*—Scully, Scott, Murphy & Presser

(57) ABSTRACT

An aiming drive (10), in particular for rapidly lining up the forked pivotal holder (10) of a launch receptacle (12) for fragmentation grenades defending against an attacking missile is to be designed, with precise simultaneous azimuth and elevation adjustment for particularly high level of dynamics of its aiming procedure in spite of a high weight of the launch receptacle (12) which is provided with the fragmentation grenades. For that purpose the setting motors (13,14) are disposed stationarily in a support structure (15) which is fixed with respect to the object, away from the pivotal holder (19) and protected from the effect of fragments, from which support structure they are rotatable connected to a carrier ring (18) for the pivotal holder (19). The carrier ring (18) is supported rotatably in the support structure (15). The elevation setting motor (13) which is also stationarily fitted into the support structure (15) coaxially with respect to the azimuthal axis (17) is provided with a translatorily acting drive output (23) which determines the elevation of the launch receptacle (12) by way of a support rod or bar (22) which extends substantially concentrically with respect to the azimuthal axis (17) and which is preferably rotatable about the latter.

6 Claims, 1 Drawing Sheet

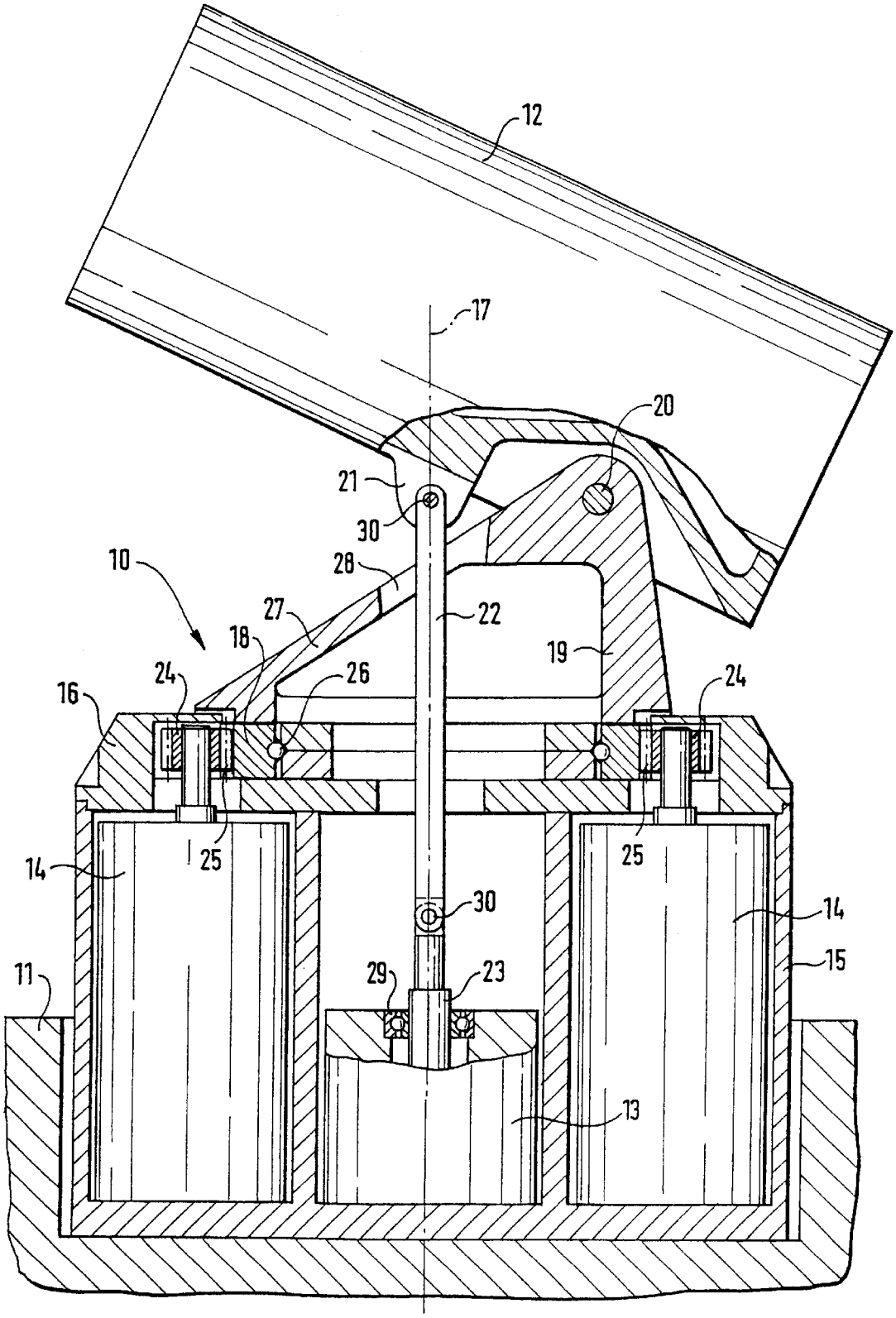
12
17
20
21
30
10
28
27
22
18
19
24
26
24
16
25
25
14
30
14
11
29
23
15
13

AIMING DRIVE

BACKGROUND OF THE INVENTION

1. Field of the Invention

The present invention relates to aiming drives for a launching arrangement located on an object, which for the alignment of a pivotal holder for the launching arrangement, possesses in a support structure fixed to the object an azimuthal setting motor with a rotational drive connected to a support ring for the pivotal holder.

The invention is further directed to the provision of an aiming drive for a launching arrangement located on an object which for the alignment of a pivotal holder for the launching device, possesses in a support structure fixed to the object an elevational setting motor with a support extending by means of a linkage connection through a support ring for the pivotal holder so as to be rotatable relative to the support structure, for enabling the elevation of the launching arrangement.

Furthermore, the invention also provides for an aiming drive for a launching arrangement located on an object, which for the alignment of a pivotal holder for the launching arrangement possesses setting motors located in a support structure which is fixed to the object.

2. Discussion of the Prior Art

Aiming drives of that type for the weapon turret of a lightweight military vehicle are known from the disclosure of European Patent Publication EP 149 639 B1. The turret which is rotatable relative to the vehicle is carried on a platform by means of a radial ball bearing which, in turn, for shock-absorbing the recoil of the gun barrel is supported through the interposition of elastic supports by the vehicle chassis. The tilting moments which act on the platform are supported thereby through a cage-like yoke frame, which is in the configuration of a hollow truncated cone, against a central shaft in the azimuthal axis of the turret rotation. For the azimuthal aiming, there is effected the rotation of the turret about this shaft by means of a pinion which is supported in the platform, and which is driven through a belt drive by a motor which is mounted on the vehicle. For the elevational aiming, the central shaft ends opposite the turret in a linear gear rack, into which there engages the pinion of a motor, the latter of which is mounted transversely thereof fastened to the vehicle, so as to displace the shaft in the direction of the azimuthal axis. Connected opposite the gear rack to this shaft is a yoke by means of a ball and socket joint. The free end surfaces thereof are quite far behind the elevational, axis, extending so as to approach the center of gravity of the gun, articulated to the gun, as a result of which the latter by means of the gear rack drive can be aimed in elevation.

These previously known drives for the aiming of a gun in accordance with azimuth and/or elevation, either considered by themselves or also in combination, are subject to a series of significant constructive and functional disadvantages which, above all, come into consideration when it is important to be able to rapidly aim a large mass, and then to dependently arrest it in position. Thus, already because of the belt drive, there is not afforded a rapid and secure azimuthal aiming, since in view of the required torsional moments for the high inertial mass of the turret with its gun, there can be expected only a slowly moving entry into the specified aiming orientation, or there must be expected an azimuthal pendeling or overtraveling, and then in view of the unavoidable play in the engagement of the teeth of the drive pinion, and due to the belt drive leading to the drive motor, that this leads to only a poorly dependable arresting in the finally reached specified aiming orientation. Also the dependability of the weapon elevation in the known construction leaves much to be desired, inasmuch as the gear rack drive, when it is not imparted due to significant friction losses an exact constructive linear guidance, necessarily operates while being subjected to an extensive degree of play. In addition thereto, there are also the constructive disadvantages of the technological manufacturing demands, and the play in a two-dimensional support in the form of the ball and socket joint for the connection of the elevational yoke to the central shaft which serves as the longitudinally displaceable support rod. Moreover, the support of the weapon in the yoke far distant from the center of gravity which is located close to the azimuthal axis, in view of the intense pivotal movements of the yoke about its ball and socket joint, is extremely disadvantageous from a kinetic as well as kinematic standpoint. Finally, especially for a mass production manufacture, these aspects are generally disadvantageous: functionally the play and the frictional losses, as well as in the manufacturing technology, the large parts and adjusting requirement for the support of the gear rack and for the yoke connection through a ball bearing for elevational aiming, as well as the belt drive for azimuthal aiming; and finally, also in the requirement for excessive installation space for the aiming motors which are to be oriented transversely of each other.

From the disclosure of German Patent Publication DE 33 41 320 A1 there is known a controllable rotational drive for the rotatable upper part, for example, of a weapon installation, which supports itself on a stationary lower part by means of a large-sized roller bearing, which is formed from three rings or races, of which two are connected secured against rotation with the lower part and, respectively, with the upper part outer races are each equipped with a drive motor, whose pinions stand in engagement with a gear ring, which protrudes sleeve-like from this race arrangement, and axially offset relative thereto is connected with a middle race which is supported between these two races so as to, in the type of a differential drive, be able to vary the torsional moment transfer between the inner race and the outer race. This azimuthal drive thus permits the implementation of a highly dynamic azimuthal adjustment of the two outer races relative to each other; however, notwithstanding the high demands on manufacturing and spatial requirements, still does not afford a dependable arresting in the assumed specified reference position.

The above mentioned disadvantages of the already considered azimuthal and elevational drives are, in particular, overwhelming when it relates to the implementation of a two-dimensional aiming drive, such as is described in U.S. Pat. No. 5,661,254 A for the rapid aiming of a heavy launch receptacle in accordance with azimuth and elevation, so as to for the active protection of a mobile or stationary object from a receptacle mounted on this object or in proximity thereto to fire fragmentation grenades against an attacking airborne body. For this purpose, from this publication there is known that a gun carriage-like support carries an azimuthally adjustable pivotal holder for the therein located tiltable launch container, which for these two aiming movements, in accordance with the prior art publication, is equipped with two setting motors which are mutually transversely oriented. Due to the large masses which are to be extremely rapidly accelerated and decelerated, such as a launch receptacle, which especially at the beginning of a combat action is equipped with a plurality of fragmentation grenades, and resultingly is heavy, the setting motors must be designed for a rapid acceleration at a high torsional moment and rapid deceleration with an intense halting or restraining moment, which requires a large magnetically operative mass; in effect, extremely heavy setting motors. This is particularly critical with regard to the unavoidable transmission losses in the rotating torque transmissions from the setting motors, on the one hand, for azimuthal rotation and, on the other hand, for the elevational pivoting of the launch receptacle. The requirement to be able to move these extremely large masses thus runs against the demand for a rapid and correct aiming of the launch receptacle toward a target.

SUMMARY OF THE INVENTION

In recognition of these conditions, the present invention has as an object to provide aiming drives for azimuthal and elevational, as well for a combined azimuthal and elevational aiming of the weapon, especially in the form of the mentioned launch receptacle, which is designed so as to be optimized to such critical demands in order to provide the most possibly rapid and most possibly free of any play, and the accurately maintainable aiming of the launch receptacle in accordance with azimuth and/or in accordance with elevation for a correct firing against a target, especially such as firing a defensive grenade against an attacking airborne body.

In accordance with essential features of the invention directed to the azimuthal aiming procedure; in effect, for a turning of the upper structure coaxially of the azimuthal axis, engaging into the inner or outer toothing of the carrier ring are the drive take-off pinions of a plurality of azimuthal setting motors which are stationary; namely, fixed to the object in the support structure and are therein concurrently protected from fragmentation effects, so as to rapidly achieve a specified azimuthal aiming upon their operative synchronization, and upon the switching over of at least one of the azimuthal setting motors to a counter torsional moment relative to at least one of the other, are able to be immediately arrested in a specified position without any play.

The bifurcated or yoke-like pivotal holder for the therein suspended launch receptacle so as to facilitate it to be aimable in elevation, which is carried through the intermediary of the rotatable ring by the support structure which is fixed to the object, which with its housing can be integrated with the object which is to be protected, is articulated to a support rod, which, in turn, is articulated to an elevational setting motor arranged in the support structure concentrically with the azimuthal axis, which is equipped with a drive relative to the setting motor coaxially rotatable about the azimuthal axis for the translation of the support rod. Expediently, integrated herein so as to engage into the rotor, is a roller screw drive in the elevation motor, so as not to require any special bearing location for the support rod. This produces in construction a small sized drive unit, and which is consequently of low-inertia, and with regard to rolling friction a functionally extremely robust drive unit without the need for providing any additional bearing components for implementation the elevational function.

In the event of the implementation of a combined azimuthal and elevational aiming drive, the setting motors are thereby arranged axially- parallel in the support structure, so as to be easily manufactured as a compactly preassembled and functionally-tested drive block or module with attachments, insertable below the platform as a multifunctional unit (namely, for azimuth and elevation, for the last-mentioned with the motor bearing concurrently serving as a drive bearing) into a pot- shaped housing.

The carrier ring for the yoke-shaped pivotal holder is carried on the platform by means of a surrounding bearing having a low axial height for the receipt of axial as well as radial loads, which is preferably designed as a known per se cross-roller bearing. As a result, the carrier ring is subjected to a radial counter bearing opposite the radial pressure exerted by the azimuthal drive pinion, while by means of this moment bearing there is also concurrently ensured the axial positioning of the support ring relative to the housing of the support structure.

The yoke-shaped pivotal holder which is mounted on the rotatable carrier ring preferably possesses somewhat the geometry of a bending-resistant right-angled triangle with unequal short sides, which by means of its lengthier short side rests secured against movement on the carrier ring, and oppositely located in the region of the transition of the axially shorter arm to the hypotenuse, is equipped offset from the azimuthal axis with a swivel eyelet for the tilting for elevational aiming by the launch receptacle which is suspended in the holder. Closely adjacent to this pivot axis, and passing transversely thereof is the central axis of the support structure which lies in coincidence with the azimuthal axis of the carrier ring. Preferably, at a middle elevation of the launch receptacle, the articulation thereof to the support rod lies exactly in coincidence with the azimuthal axis. Due to the only slight mutual offset between the two articulated joint locations of the launch receptacle (pivot axis and support articulation) the coupling to the elevation motor in the form of the support rod, during the elevational aiming of the launch receptacle, carries out only extremely slight deviations from the azimuthal axis, so that this rod is subjected by the heavy launch receptacle during its is short lever path to practically no bending, but essentially only to thrust loading.

The launch receptacle is supported by way of the coupling rod or bar along the azimuthal axis on a translatory drive output of the elevation setting motor which is arranged in concentric relationship with the carrier ring and thus in coaxial relationship with the azimuthal axis, also in fixed relationship with the object, in the housing of the support structure. This drive output is, for example, a telescope or preferably a means for conversion from a rotary motor movement into a linear drive output movement by way of a spindle nut on a screwthreaded rod. The elevation setting motor overall or at any event its drive output member are rotatable relative to the support structure unless the support rod or bar is rotatable in itself or by way of at least one ball-headed joint relative to the support structure because the carrier ring rotates about the azimuthal axis for azimuthal aiming and in so doing entrains the coupling from the elevation motor which is fixed with respect to the object to the launch receptacle which in contrast is rotatable. If, however, no rotatable coupling is installed here, that is to say, an elevation setting motor which is fixed with respect to the support structure is not coupled to the launch receptacle with at least one ball joint but only with hinge-type joints by way of the support rod or bar, then that results in a geometrically governed change in elevation in dependence on the azimuth adjustment, which however can be reliably compensated precisely for that reason in the event of elevation control as an error influence which is defined in dependence on azimuth.

This therefore provides for an aiming drive which is particularly suitable for integration on large vehicles as the large masses of the setting motors are carried by the support structure which is fixed with respect to the object, that is to say which is stationary with respect for example to the vehicle to be protected, and they are no longer carried on the carrier ring which is azimuthally adjustable thereon. The latter only has to carry the weight of the launch receptacle including the pivotal holder thereof, which is supported by way of a rotational bearing or mounting arrangement on the support structure which now, as a result of integration of the setting motors, is in particular of a high mass and which therefore advantageously is sluggish in reaction in relation to the aiming procedures.

BRIEF DESCRIPTION OF THE DRAWINGS

Additional alternatives and developments as well as further features and advantages of the invention will be apparent from the description hereinafter of a preferred embodiment of the structure according to the invention, which is diagrammatically shown in greatly simplified from in the drawing approximately true to scale, being limited to what is essential. The single FIGURE of the drawing is a view in axial longitudinal section showing the structure of a launch aiming drive with rotational azimuth setting which is relieved of load in terms of apparatus structure, and rapid linear elevation setting.

DETAILED DESCRIPTION OF A PREFERRED EMBODIMENT

The aiming drive 10 designed in accordance with the invention, which is shown in diagrammatic form for the sake of simplicity of illustration, serves to protect a stationary or mobile object 11 from an approaching high-speed guided missile (not shown in the drawing) by firing theretowards at least one fragmentation shell or grenade from a launch receptacle 12 is carried by the object 11 to be protected, by way of the aiming drive 10, so that, after sensing of the direction of the threat, it is possible to orient the launch direction of the defense shells or grenades which are to be fired off very rapidly in terms of azimuth and elevation towards the attacking missile—as described in greater detail in above-mentioned U.S. Pat. No. 5,611,254 A in regard to the operative mechanism of the fragmentation defense shells, reference being expressly directed thereto at this point for the avoidance of repetition.

In order to minimize the masses which have to be moved extremely quickly when aiming at the attacker to be defended against, and consequently also to minimize the kinetic loading on the object 11 to be protected as the carrier for the aiming drive 10, in the aiming procedure, the setting motors 13,14 are not moved with the launch receptacle 12 but are installed in the housing of a support structure 15, which is fixed with respect to the object, of the aiming drive 10, as is symbolically illustrated in the drawing by the cup-shaped housing which is recessed into the object 11. This cup-shaped support structure 15 for stationarily mounting the setting motors 13,14 and for rotationally supporting a pivotal holder 19 of the launch receptacle 12 has a base plate 16 which covers the housing (which is at least partially recessed into the object supporting it) and which is designed for azimuth setting in particular lateral armouring also as fragmentation protection. On or in the base plate 16 the support structure 15 carries a carrier ring 18 which is rotatable bout the central axis of the system, namely the azimuthal axis 17 of the aiming drive 10, for the pivotal holder 19 which is rigidly connected to the carrier ring 18 and which opens upwardly in a forked configuration and in which the launch receptacle 12 is eccentrically suspended by a pivot axis 20. Closely therebeside, the launch receptacle 12 is pivotably connected by an eye 21 to a support rod or bar 22 which extends axially substantially along the azimuthal axis 17 through the center of the carrier ring 18 and extends downwardly to an oppositely disposed coupling location 30 for the purposes of pivotal connection there to the translatory drive output 23, which is coaxial with the azimuthal axis 17, of the elevation setting motor 13.

For azimuthal rotation of the carrier ring 18 and therewith the pivotal holder 18 together with its launch receptacle 12, at least one azimuth setting motor 14 is arranged stationarily in the support structure 15 and preferably parallel to the azimuthal axis 17. In the region of the base plate 16 it is rotationally rigidly connected to the carrier ring 18, in the illustrated example by a drive output pinion 24 in relation to an internal or external tooth arrangement 25 on the carrier ring 18. The tooth arrangement 25 at the rotational bearing or mounting arrangement for the carrier ring 18 represents the sole functional interface which requires adjustment between the stationary support structure 15 and the rotating pivotal holder 19. Disposed radially opposite this rotational engagement, for radially supporting same and preferably designed at the same time for axially holding same, is at least one rolling bearing disposed in the base plate 16 which, as diagrammatically illustrated, can extend around the assembly in an annular configuration but which in principle can also comprise individual bearings which are displaced peripherally relative to each other. The bearing design is preferably in the form of a rotational bearing or mounting arrangement 26 which extends peripherally within the carrier ring 18 and which, by way of its rolling tracks or races which are at a right angle relative to each other, can carry both axial and also radial forces.

Desirably at least two azimuth setting motors 14 are distributed for example equidistantly over the periphery of the carrier ring 18. On the contrary the elevation setting motor 13 is stationarily embedded in the support structure 15 under the carrier ring 18 in concentric relationship with the azimuth axis 17. The elevation setting motor 13 can be designed, for example, with a translatory drive output 23 in the form of a telescope or for conversion of the rotational drive output movement by means of bearing 29 into a translatory drive output movement of the motor 13, it can be in the form of a sliding nut on a motor shaft with a screwthreaded spindle for example in the manner of a roller thread drive or a trapezium spindle. That drive output 23 is connected to the launch receptacle 12 by way of a support rod or bar 22 so that it can already be raised or lowered relative to the support structure 15 during azimuth setting and/or in the azimuth position which has been attained at that time. In the interest of having a large collision-free setting angle around the horizontal elevational axis 20, the hypotenuse 27, which is opposite to the carrier ring 18, of the approximately triangular pivotal holder 19 has an opening 28 of very large area in relation to the diameter of the support rod or bar 22 and into which the eyelet 21 on the launch receptacle 12, for coupling the support rod or bar 22 thereto, can entirely engage.

The spacing between the pivot axis 20 for elevation of the launch receptacle 12 and the eyelet 21 for elevational support on the support rod or bar 22 is selected to be as small as possible so that, on both sides of a mean elevation, the degree of deflection movement of the support rod or bar 22 away from the azimuthal axis 17 remains as small as possible and it is thereby possible to provide for transmission of pressure from the linear drive output 23 of the setting motor 13, in a practically bending moment-free condition, that is to say, which is kinetically as ideal as possible.

The operative connection between the elevation setting motor 13 and the launch receptacle 12 is here rotatable relative to the support structure 15 because the launch receptacle 12, in the interest of low masses which are to be rotated, experiences an azimuthal setting relative to the elevation setting motor 13 which is arranged stationarily in the support structure 15. The rotatability which prevents the elevation from being influenced during and by virtue of azimuthal orientation can be involved n the translatory drive output 23 relative to its setting motor 13, as diagrammatically indicated in the sketch by a rotary bearing 26, in order to be able to design the pivotal connections of the support rod of bar 22 on the one hand to launch receptacle 12 and in opposite relationship thereto the elevation setting motor 13, in the form of one-dimensional pivotal joints. Rotatability however can also be insured by virtue of at least one of those two coupling locations 30 being in the form of a ball joint so that then the rotary movement during azimuth setting is not effected at the drive output side directly at the elevation setting motor 13 but in at least one of those coupling locations 30. In particular also linear sliding bearings which are critical in terms of the function involved are also avoided in that way.

An aiming drive 10 which can be integrated into an object 11 which is to be protected, for rapidly lining up the forked pivotal holder 19 of a launch receptacle 12 for fragmentation shells or grenades for defending against an attacking projectile, is distinguished therefore in the design configuration according to the invention by virtue of the possibility of precise simultaneous azimuth and elevation settings with a particularly high level of dynamics in terms of that aiming procedure in spite of a high weight for the launch receptacle 12 which is equipped with the fragmentation shells or grenades. For that purpose, the setting motors 13,14 are disposed in a support structure 15 which is fixed with respect to the object, away from the pivotal holder 19 and protected from a fragmentation effect, for example in parallel relationship with the azimuthal axis 17; in the support structure 15 the setting motors are rotationally connected to a carrier ring 18 being supported rotatably in the support structure 15 by means of a moment bearing or mounting arrangement 26. In this case the elevation setting motor 13 which is also stationarily intergrated into the support structure 15 coaxily with respect to the azimuthal axis 17 is provided with a translatorily acting drive output 23 which determines the elevation of the launch receptacle 12 by way of a support rod or bar 22 which extends substantially concentrically with respect to the azimuthal axis 17 and which is rotatable therearound. Thus, the required torque for orientation of the launch receptacle 12 is substantially reduced because the heavy setting motors 13, 14 are arranged, as an immovable reaction mass, in the support structure 15. Between the latter and the pivotal holder 19 there is only the azimuth interface in the form of its carrier ring 18 which can be braced with respect to the support structure 15 which is fixed with respect to the object, in a defined manner by way of the bearing or mounting arrangement 26—without play in the absence of a sliding bearing arrangement, that is to say, rigidly in terms of the transmission configuration involved, for high-dynamic control of high forces. The translatory elevation setting which is rotatable with the launch receptacle 12 relative to the support structure 15 about the azimuthal axis 17 avoids additional torque loadings on the system which thus has become adapted to overall carry mechanically high loadings for the rapid aiming procedure.

What is claimed is:

1. An aiming drive (10) for a launching device which is arranged on an object (11); a pivotal holder (19) of the launching device being located on a pot-shaped support structure (15), an elevational setting motor (13) stationarily arranged in said support structure said having a support element (22) which is rotatable relative to said support structure (15), said elevational setting motor being arranged in said support structure (15), said support element (22) having an articulated point and extending through a carrier ring (18) supporting the pivotal holder (19) so as to facilitate the elevation of said launching device, wherein for defense against an airborne body attacking the object, through the intermediary of fragmentation grenades launched from the launching device which is formed as a launch receptacle (12), for the rapid elevation aiming of the launch receptacle (12) said support structure (15) is arranged concentrically with an azimuthal axis (17) of said elevational setting motor (13), said motor being equipped with a translatory drive output (23) which is rotatable relative to said setting motor (13) about said azimuthal axis (17), said support element (22) comprising a support rod which is articulated to said drive output (23), and wherein said launch receptacle (12) rests on said support rod (22).

2. An aiming drive according to claim 1, wherein said carrier ring (18) is rotatable in conjunction with said pivotal holder (19); and a moment bearing (26) of low height having said pivotal holder (19) on said carrier ring (18) being radially and axially supported on said pot-shaped support structure (15).

3. An aiming drive according to claim 1, wherein said pivotal holder (19) possesses the geometry of a right-angled triangle having unequally lengthy sides, a lengthier side (27) of said sides resting at one end thereof secured against movement on said carrier ring (18) and being equipped at an opposite end with a pivotable eyelet for the tilting axis (20) of the launch receptacle (12).

4. An aiming drive according to claim 3, wherein said launch receptacle (12) includes any eyelet (21) in proximity to the tilting axis (20) for articulating said receptacle to one end of said support element (22), which proximate an opposite end is articulated to the translatory drive output (23) of said elevational setting motor (13).

5. An aiming drive according to claim 4, wherein said translatory drive output (23) of said elevated setting motor (13) extends coaxially with the azimuthal axis (17) of said elevational setting motor (13), and includes one-dimensional pivot-linkages.

6. An aiming device according to claim 1, wherein said pot-shaped support structure (15) is fixedly connected with said object (11).

* * * * *